US008905770B2

(12) United States Patent
Fujiwara

(10) Patent No.: US 8,905,770 B2
(45) Date of Patent: Dec. 9, 2014

(54) CONNECTOR DEVICE WITH ELECTRICAL CONNECTION DETECTION FUNCTION

(71) Applicant: Sumitomo Wiring Systems, Ltd., Yokkaichi, Mie (JP)

(72) Inventor: Michiyo Fujiwara, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 7 days.

(21) Appl. No.: 13/747,912

(22) Filed: Jan. 23, 2013

(65) Prior Publication Data

US 2013/0203286 A1 Aug. 8, 2013

(30) Foreign Application Priority Data

Feb. 2, 2012 (JP) ..... 2012-021080

(51) Int. Cl.

| | |
|---|---|
| ***H01R 13/53*** | (2006.01) |
| ***H01R 13/621*** | (2006.01) |
| ***H01R 13/516*** | (2006.01) |
| ***H01R 13/707*** | (2006.01) |
| ***H01R 13/713*** | (2006.01) |
| *H01R 13/74* | (2006.01) |
| *H01R 13/645* | (2006.01) |

(52) U.S. Cl.

CPC ..... *H01R 13/516* (2013.01); *H01R 13/6215* (2013.01); *H01R 13/748* (2013.01); *H01R 13/707* (2013.01); *H01R 13/645* (2013.01); *H01R 13/713* (2013.01)

USPC ..... 439/181

(58) Field of Classification Search

USPC ..... 439/181–189

See application file for complete search history.

(56) References Cited

U.S. PATENT DOCUMENTS

| | | | | |
|---|---|---|---|---|
| 4,957,449 | A | 9/1990 | Hatagishi | |
| 6,982,393 | B2 | 1/2006 | Matsui et al. | |
| 7,731,514 | B2 * | 6/2010 | Hughes et al. | 439/181 |
| 7,789,690 | B1 | 9/2010 | Rhein | |
| 8,192,212 | B2 * | 6/2012 | Casses et al. | 439/181 |
| 8,262,413 | B2 * | 9/2012 | Fujiwara et al. | 439/607.28 |
| 8,469,731 | B2 * | 6/2013 | Gloaguen et al. | 439/181 |
| 2007/0291425 | A1 * | 12/2007 | Yugou | 361/23 |
| 2011/0053404 | A1 | 3/2011 | Tsuruta et al. | |

* cited by examiner

*Primary Examiner* — Chandrika Prasad

(74) *Attorney, Agent, or Firm* — Gerald E. Hespos; Michael J. Porco; Matthew T. Hespos

(57) ABSTRACT

Two connectors (20, 40) are separated until an initially connected state is reached by rotating a nut (70) in a loosening direction to release the nut (70) from a threadedly engaged state in a properly connected state of the two connectors (20, 40), and an interlock circuit is turned off during this time to set a power supply circuit to a cut-off state. A partial locking mechanism (80) is provided between the two connectors (20, 40) for preventing any further separation by locking the power-supply side connector (40) when the power-supply side connector (40) is separated up to an initial connection position and enabling the power-supply side connector (40) to be completely separated when a specified force or larger is applied to the power-supply side connector (40).

5 Claims, 10 Drawing Sheets

CONNECTOR DEVICE WITH ELECTRICAL CONNECTION DETECTION FUNCTION

BACKGROUND OF THE INVENTION

1. Field of the Invention

The invention relates to a connector device having an electrical connection detection function.

2. Description of the Related Art

A connector device for supplying power to a vehicle-mounted device includes a device side connector and a power-supply side connector to be connected to each other. The device side connector has a male housing integrally formed on an outer surface of a junction box. The male housing includes a connection recess and a male terminal made of a busbar projects from the back surface of the male housing. The power-supply side connector has a female terminal connected to an end of a wire drawn out from the power supply and accommodated in a female housing. The corresponding male and female terminal fittings in the two connectors are connected to form a power supply circuit when the two connectors are connected.

Arc discharge may occur between the corresponding male and female terminal fittings of the connectors when the power-supply side connector is separated while power is supplied from the power supply. Thus, an interlock circuit for electrically detecting a connected/separated state of the connectors is provided between the two connectors. The interlock circuit is turned on to set the power supply circuit to a conductive state when the connectors are connected properly. On the other hand, the interlock circuit is turned off to set the power supply circuit to a cut-off state before the two connectors are separated. The interlock circuit is interposed in a load side circuit of the power supply circuit and the load side circuit is switched between a conductive state and a cut-off state by turning on and off the interlock circuit. A connector device with such an interlock circuit is disclosed, for example, in U.S. Pat. No. 6,982,393.

Electric charges may still remain in the load-side circuit or on the male terminal immediately after the power-supply side connector is pulled apart even if the interlock circuit is turned off to set the power supply circuit to the cut-off circuit. An operator who inadvertently touches the male terminals could suffer from an electrical shock or the like if the two connectors are separated completely to expose a connecting surface of the device side connector in this state. Thus, a further improvement has been desired.

The invention was completed in view of the above situation and an object thereof is to enable two connectors to be separated only after the elapse of a delay time after a power supply circuit is cut off.

SUMMARY OF THE INVENTION

The invention relates to a connector device with a device side connector and a power-supply side connector. The device side connector is provided in or on a device and includes a connection terminal. The power-supply side connector is provided on an end of a power-supply side wire and includes another connection terminal to be connected to the connection terminal of the device side connector to form a power supply circuit. One of a bolt and a nut is mounted fixedly on the device and the other is mounted rotatably on the power-supply side connector. An interlock circuit is provided over the two connectors and is configured to switch the power supply circuit between a conductive state when the connectors are connected properly and a cut-off state at other times.

The bolt and the nut are brought into contact when the two connectors are first connected a specified distance and the connection terminals start to be connected to each other to form the power supply circuit. The two connectors gradually are connected further by rotating the nut and/or the bolt in a tightening direction in an initially connected state, and the interlock circuit is turned on to set the power supply circuit to the conductive state when the two connectors are connected properly. The two properly connected connectors are separated until the initially connected state is reached by rotating the nut and/or the bolt in a loosening direction to threadably disengage the bolt and nut and the interlock circuit is turned off during this time to set the power supply circuit to the cut-off state. A partial locking mechanism is provided between the two connectors for preventing any further separation by locking the power-supply side connector when the power-supply side connector is separated up to an initial connection position and enabling the power-supply side connector to be separated completely when a specified force or larger is applied to the power-supply side connector.

Loosening the nut and/or the bolt gradually separates the power-supply side connector from the device side connector until the nut and the bolt are threadedly disengaged from each other. The partial locking mechanism temporarily prevents further separation of the power-supply side connector when the power-supply side connector is separated to the initial connection position and the interlock circuit is turned off during this time to set the power supply circuit to the cut-off state. Thereafter, the power-supply side connector can be grabbed and pulled with a specified force or larger so that the power-supply side connector is pulled apart and released from the locked state by the partial locking mechanism.

The power-supply side connector is separated completely a certain time after the power supply circuit is set to the cut-off state. Electric charges that remain on the connection terminal of the device side connector are lost during the delay so that an operator will not be electrical shocked by inadvertent contact with the connection terminal.

The partial locking mechanism preferably is formed so that the power-supply side connector and the device side connector include a locking portion and an engaging portion that are brought into contact and engage each other. At least one of locking surfaces of the locking portion and the engaging portion preferably is inclined an obtusely.

The locking portion and the engaging portion move over each other along the inclined surface and disengage if the power-supply side connector is pulled with a specified force or larger in a state where the locking portion and the engaging portion are engaged. The power-supply side connector then is pulled apart. Thus, the partial locking mechanism is formed by a simple structure.

The head of the bolt could be mounted on the power-supply side connector so that the shaft of the bolt is cantilevered from the power-supply side connector. However, the shaft of a bolt mounted in this manner could incline so that the leading end of the shaft of the bolt is not be brought smoothly into contact with the mating nut when the two connectors initially are connected. On the other hand, the nut is small and light and is less likely to incline when mounted on the power-supply side connector. Thus, the nut that is mounted on the power-supply side connector can be brought accurately into contact with the leading end of the bolt as the two connectors initially are connected and a connecting operation of the connectors becomes easier. Accordingly, the bolt preferably is mounted on the device, and the nut preferably is mounted on the power-supply side connector.

The device side connector preferably is provided in or on a conductive metal case. Additionally, the wire preferably is a shielded cable, a shield shell connected to a shield layer of the shielded cable preferably is mounted on the power-supply side connector.

The bolt and the nut preferably are provided on the case and a mount plate is provided on the shield shell to be mounted to the case. Thus, the case and the mount plate of the shield shell are brought into contact as the bolt and the nut are tightened together. This configuration is applied effectively to a shield-type connector device.

These and other features and advantages of the invention will become more apparent upon reading the following detailed description and accompanying drawings.

DETAILED DESCRIPTION OF THE PREFERRED EMBODIMENTS

Figure 3:
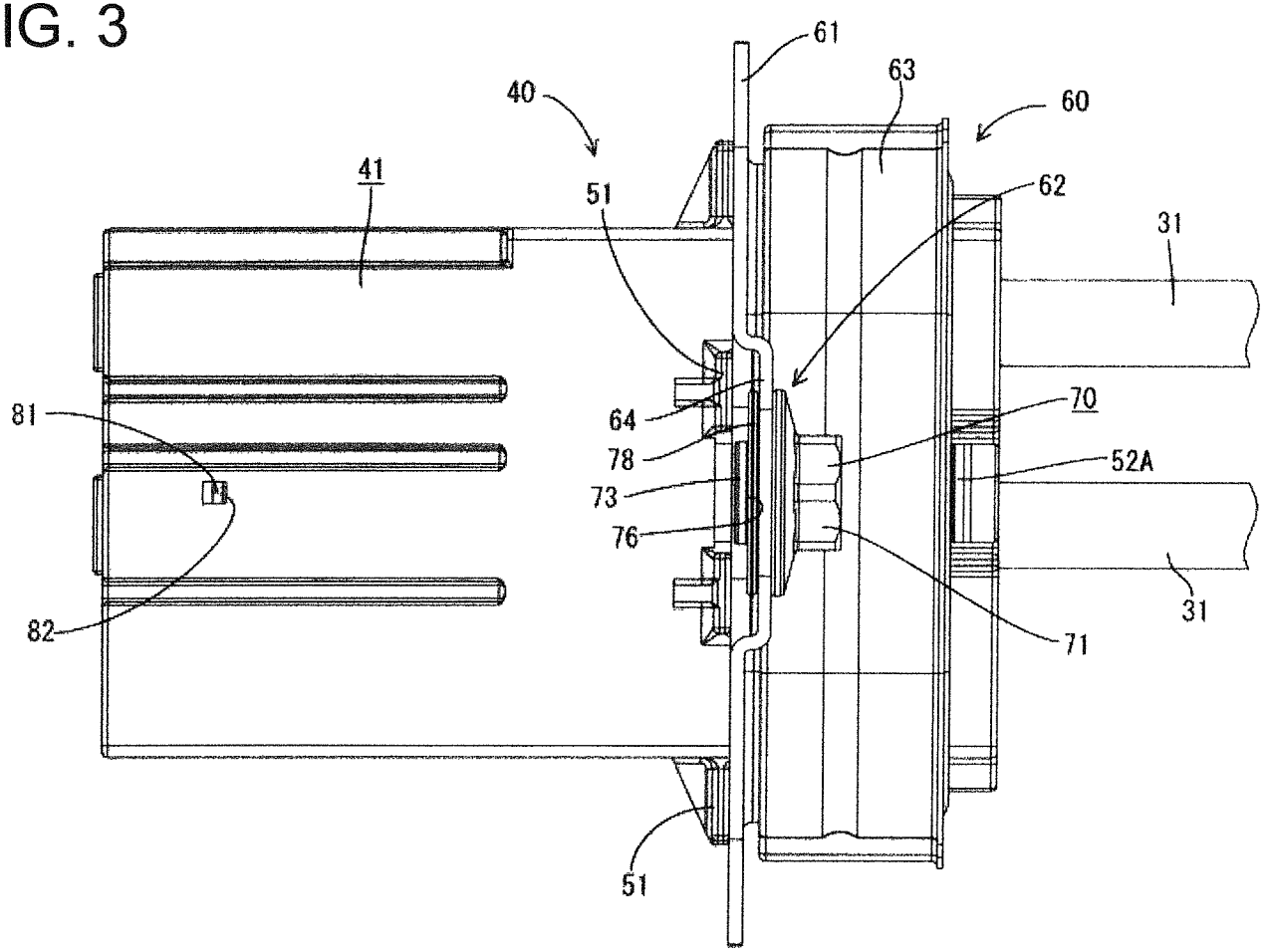
FIG. 3 is a plan view of the power-supply side connector.
Figure 4:
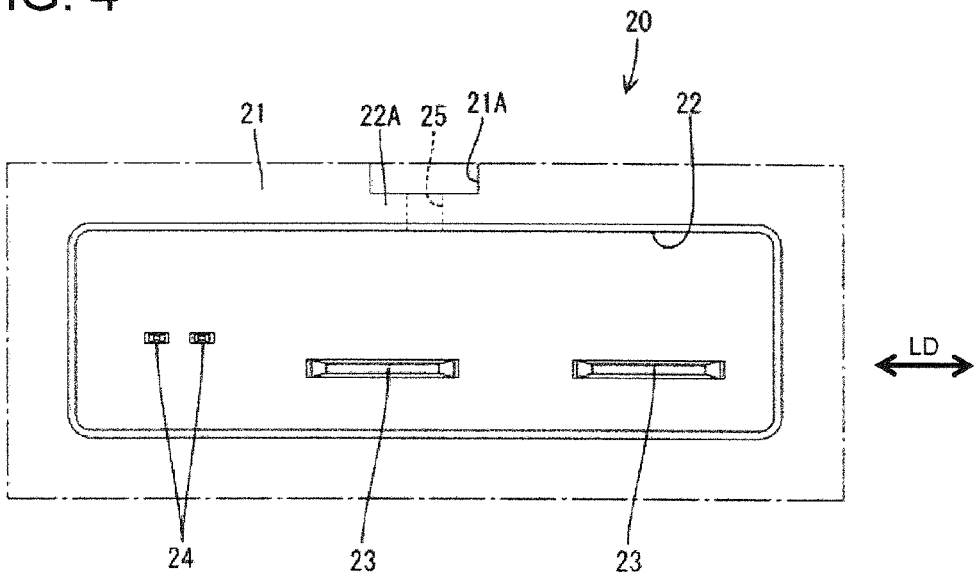
FIG. 4 is a schematic front view of a device side connector.
Figure 5:
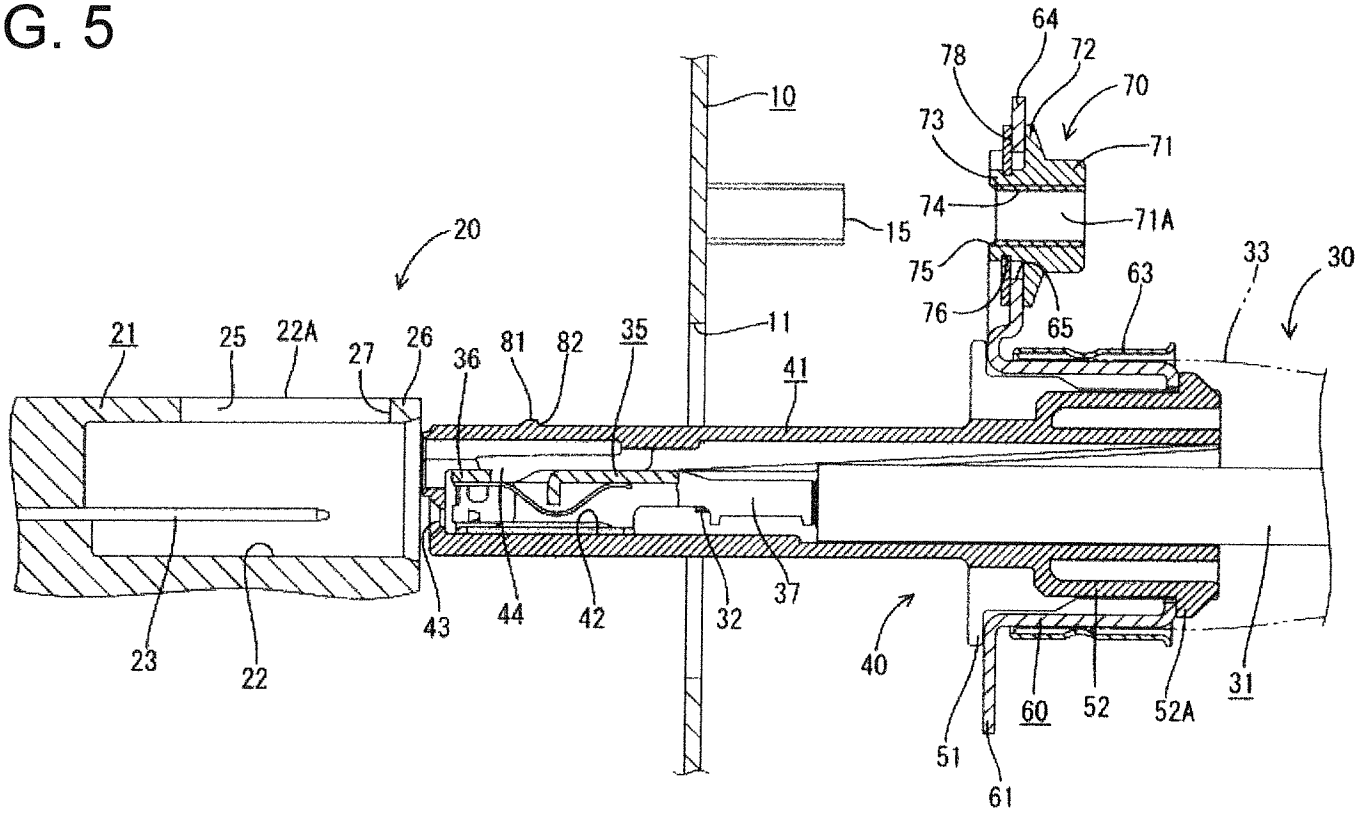
FIG. 5 is a longitudinal section along a connecting part of connection terminals in a state where the device side connector and the power-supply side connector are connected.
Figure 6:
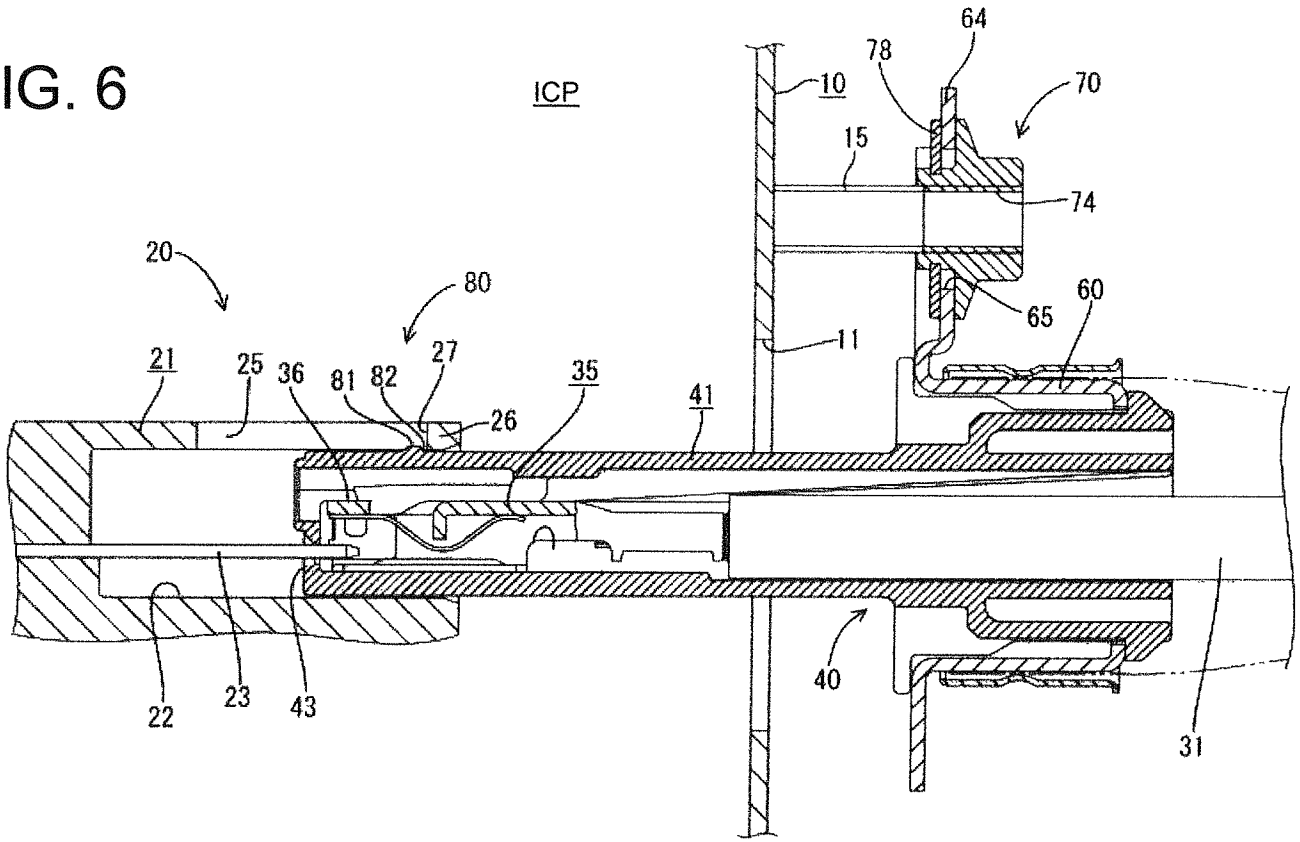
FIG. 6 is a longitudinal section along a switch portion of an interlock circuit.

A connector device in an electrical system connecting a power supply and a vehicle-mounted device is illustrated in FIGS. 1-10. The connector device comprises a device side connector 20 mounted in a case 10 and a power-supply side connector 40 connected to an end of a shielded cable 30 drawn out from the power supply and connected to the device side connector 20, as shown in FIGS. 5 and 6.

A device side connector 20 is formed integrally or unitarily with a male housing 21 by forming a connection recess 22 on a side surface of a junction box (hereinafter, "J/B"). As shown in FIG. 4, the connection recess 22 has a substantially rectangular cross-section that is long in a lateral direction LD when viewed from the front. The interior of the connection recess 22 is divided into three areas in the lateral direction, and male terminals 23 formed of a busbar project from the back surface in central and right end areas. Specifically, the male terminals 23 substantially are arranged side by side in the lateral direction LD with the plate surfaces thereof substantially aligned and project more than about half (e.g. about ¾) of the depth of the connection recess 22.

Two male tabs 24 project in the left end area in the connection recess 22 and form a fixed contact 86A of a switch portion 85 (see FIG. 10) in an interlock circuit to be described later. The male tabs 24 project substantially side by side while being apart by a specified distance. A projecting length of the male tabs 24 is more than about ⅓ (e.g. about 4/10) of the depth of the connection recess 22.

Although not shown, a load side circuit is formed in the device side connector 20. The interlock circuit is on when the male tabs 24 are in an electrically connected state and the load side connector is in a conductive state. On the other hand, the interlock circuit is off when the male tabs 24 are not connected, and the load side connector is in a cut-off state.

The J/B in which the above device side connector 20 is provided is housed into the case 10, which is made of conductive material (e.g. such as aluminum), and is fixed at a specified position.

A substantially rectangular connection opening 11 is formed at a specified position of a side surface of the case 10 and is slightly larger than the opening of the connection recess 22 of the device side connector 20, as shown in FIGS. 5 and 6. The connection recess 22 of the device side connector 20 aligns with the connection opening 11 as the J/B is housed and an opening surface of the connection recess 22 is arranged at a specified distance from the inner back side of the connection opening 11.

Figure 1:
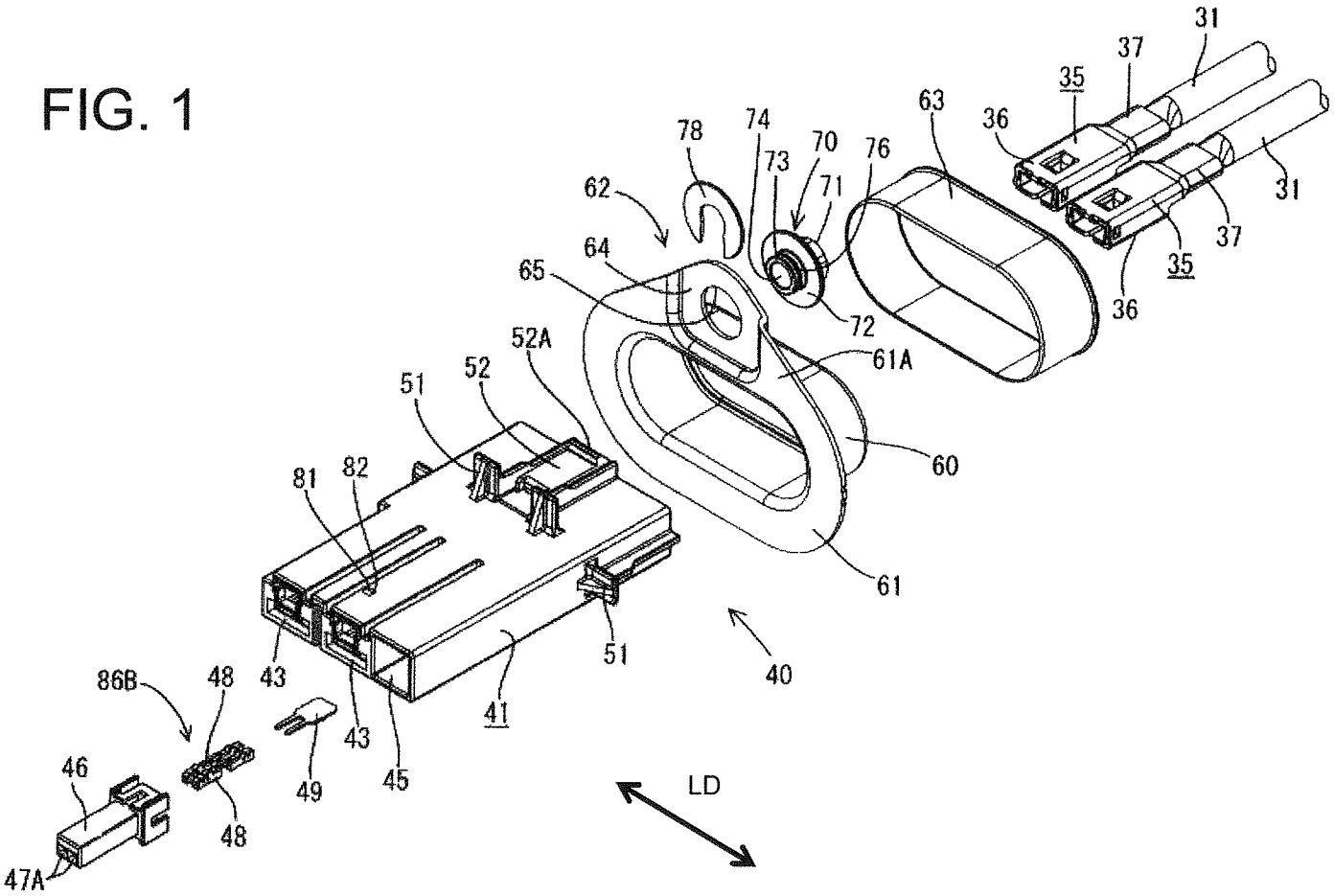
FIG. 1 is an exploded perspective view of a power-supply side connector.
Figure 2:
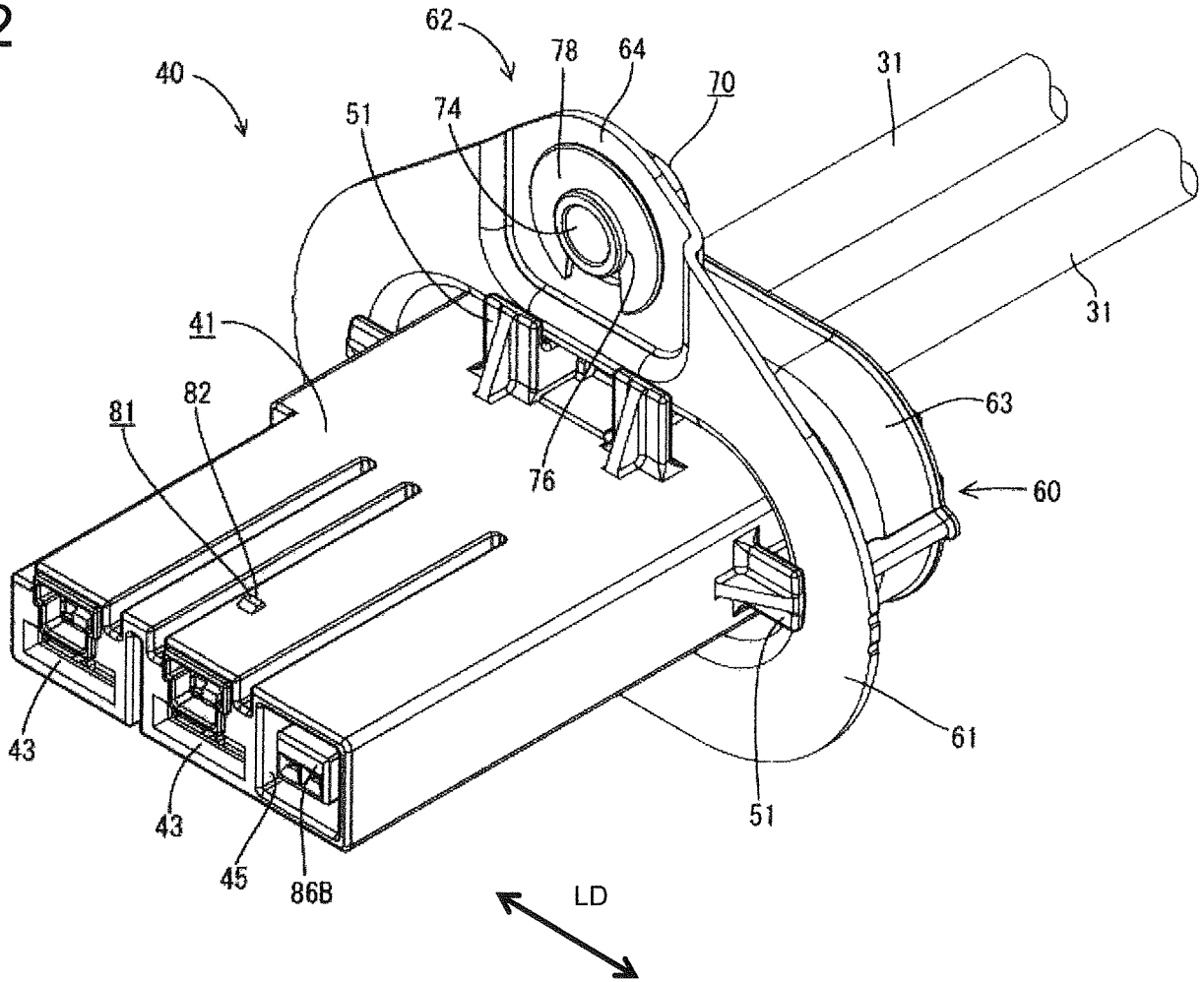
FIG. 2 is a perspective view of the power-supply side connector.

The power-supply side connector 40 comprises a female housing 41 with female terminals 35 fixed to the end of the shielded cable 30, and a shield shell 60 is mounted on a rear part of the female housing 41, as shown in FIGS. 1 to 3.

The shielded cable 30 is structured so that two insulated wires 31 are inserted into a sheath (not shown) with a braided wire 33 mounted around them. The female terminals 35 are fixed to ends of the respective insulated wires 31.

Each female terminal 35 is formed by press-working a conductive metal plate having excellent electrical conductivity and includes a flat rectangular tubular connecting portion 36 to which the male terminal 23 in the device side connector 20 is fit. A wire connection barrel 37 is provided behind the connecting portion 36 and is to be crimped and connected to an end of a core 32 of the insulated wire 31.

The female housing 41 is made e.g. of synthetic resin and is substantially in the form of a flat block that can fit tightly into the connection recess 22 of the male housing 21. The female housing 41 particularly is divided into three areas in the lateral direction LD when viewed from the front, and cavities 42 are formed in central and left end areas for receiving the female terminals 35 from behind. A terminal insertion opening 43 is formed in the front wall of each cavity 42 for receiving the male terminal 23, and a resilient locking lance 44 is formed at the ceiling surface of the cavity 42 for retaining the connecting portion 36 of the female terminal 35.

The female terminal 35 displaces the locking lance 44 during insertion of the female terminal 35 into the corresponding cavity 42 from behind. The locking lance 44 resiliently restores when the female terminal is inserted properly and engages the connecting portion 36 to retain the female terminal 35 in the cavity 42.

A mounting hole 45 is formed in the right end area of the female housing 41, and a movable contact 86B of the switch 85 in the interlock circuit is mounted in the mounting hole 45. The movable contact 86B is structured so that two accommodating chambers 47A are juxtaposed laterally in a stepped tube body 46 made e.g. of synthetic resin, intermediate terminals 48 are accommodated in the respective accommodating chambers 47 and the rear ends are connected by a short pin 49. A tab insertion hole 47A is formed in the front wall of each accommodating chamber 47 and receives the male tab 24 serving as the fixed contact 86A of the male housing 21. The movable contact 86B is inserted into the mounting hole 45 and fixed by a lock mechanism at a position where the front surface of the tube body 46 is substantially flush with the front opening of the mounting hole 45.

The shield shell 60 is to be mounted on the rear part of the female housing 41. The shield shell 60 is formed by press-working or deep drawing a conductive metal plate made of, e.g. aluminum, and has an elliptical tube shape. A flange 61, which serves as a mount plate, bulges out on the front edge of the shield shell 60. The upper edge of the flange 61 is extended to have a pointed or mountain shape and a mounting portion 62 for a nut 70 is provided at this extended portion 61A.

The shield shell 60 is fit from behind onto the female housing 41 and is stopped when the front edge contacts stoppers 51 projecting on the outer surface of the female housing 41. Engaging projections 52A of lock pieces 52 on the upper and lower surfaces of the female housing 41 engage the rear edge of the shield shell 60 to hold the shield shell 60 on the outer periphery of the rear part of the female housing 41, as shown in FIGS. 2 and 3.

As shown in FIG. 5, an end of the braided wire 33 of the shielded cable 30 is fit on the outer periphery of the shield shell 60 and is fixed by crimping a crimp ring 63 on the outer periphery thereof.

A stud bolt 15 extends substantially horizontally at a widthwise central part of an upper edge part of the connection opening 11 in the case 10 of the device.

The nut 70 that engages threadedly with the stud bolt 15 is mounted on the shield shell 60 of the power-supply side connector 40. As shown in FIGS. 1 and 5, the nut 70 has a main body 71 with a center hole 71A. A flange 72 projects out from the main body 71 and a short cylindrical portion 73 projects substantially concentrically from an end of the main body 71. An internally threaded portion 74 is formed over the inner periphery of the cylindrical portion 73 from the center hole 71A of the main body 71 and a tapered guiding surface 75 is formed on the front end of the internally threaded portion 74. An insertion groove 76 is formed on the outer periphery of the cylindrical portion 73 at a position spaced from the flange 61 by the thickness of the case 10 and can receive a C-ring 78.

The extended portion 61A on the upper edge of the flange 61 of the shield shell 60 is formed with the mounting portion 62 for the nut 70. Specifically, the extended portion 61A is shaped to form a mounting plate 64 that is retracted slightly backward, and a supporting hole 65 is formed in the mounting plate 64 for receiving the cylindrical portion 73 of the nut 70. This supporting hole 65 defines a circle with an inner diameter larger than an outer diameter of the cylindrical portion 73 and is substantially concentric with an axis line of the stud bolt 15, as shown in FIG. 5, when the female housing 41 is connected to the male housing 21.

The nut 70 is stopped when the cylindrical portion 73 is inserted into the supporting hole 65 from behind and the flange 72 contacts the rear surface of the mounting plate 64. At that time, the leading end of the cylindrical portion 73 is at a position flush with or slightly backward of the front surface of the flange 61 of the shield shell 60. The C-ring 78 is inserted into the insertion groove 76 on the outer periphery of the cylindrical portion 73 in this state. Thus, the front and back sides of a hole edge part of the supporting hole 65 are sandwiched between the C-ring 78 and the flange 72. The nut 70 is supported is rotatably about an axis line while movement along an axial direction is prevented. Further, the cylindrical portion 73 is inserted with a clearance into the supporting hole 65. Thus, the position of the nut 70 can be adjusted along the mounting plate 64 in a direction substantially perpendicular to the axis line within the range of this clearance.

Figure 10:
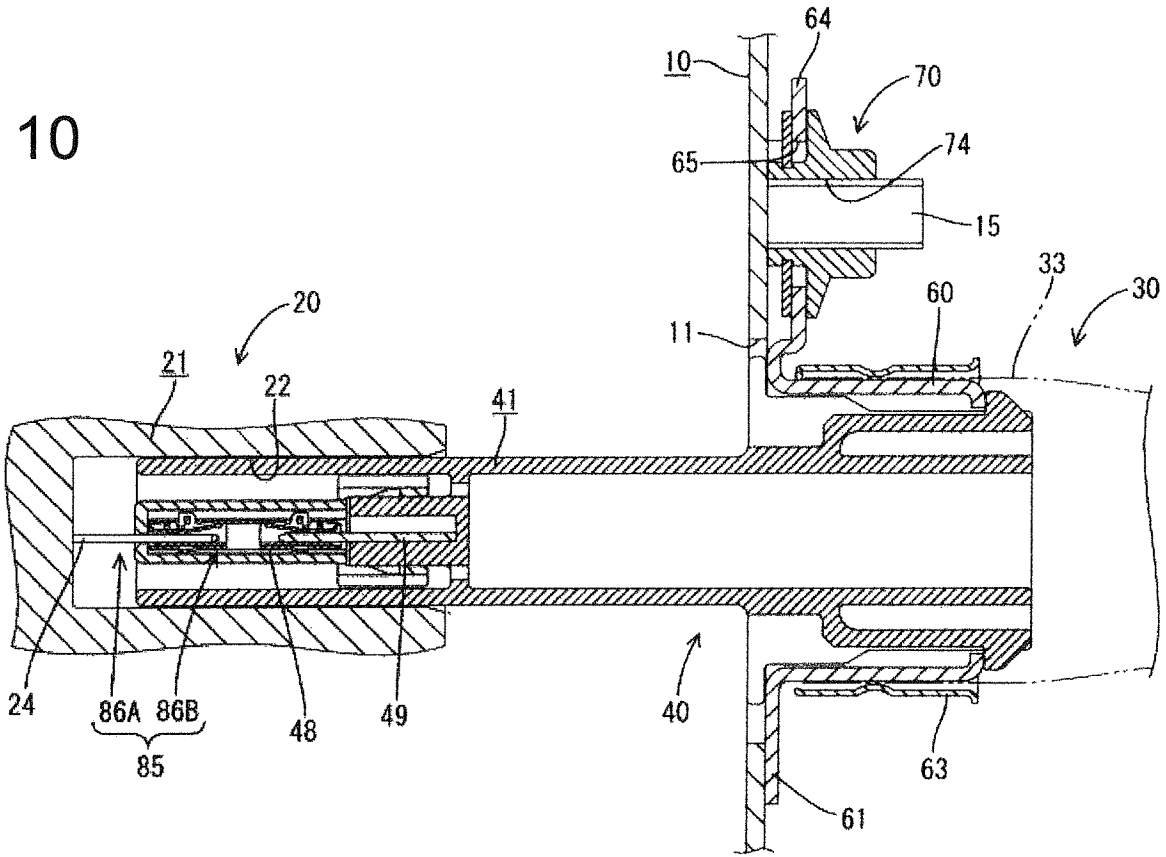
FIG. 10 is a longitudinal section along the switch portion of the interlock circuit.

The power-supply side connector 40 is fit into the connection recess 22 of the device side connector 20 through the connection opening 11 of the case 10. The leading end of the internally threaded portion 74 of the nut 70 contacts the leading end of the stud bolt 15 when the power-supply side connector 40 reaches an initial connection position ICP that is slightly less than half the depth of the connection recess 22. The corresponding male and female terminals 23, 35 start connecting at the initial connection position ICP, as shown in FIG. 6, but the male tab 24 and the intermediate terminal 48 of the switch portion 85 of the interlock circuit are not connected yet, as shown in FIG. 10.

Figure 8:
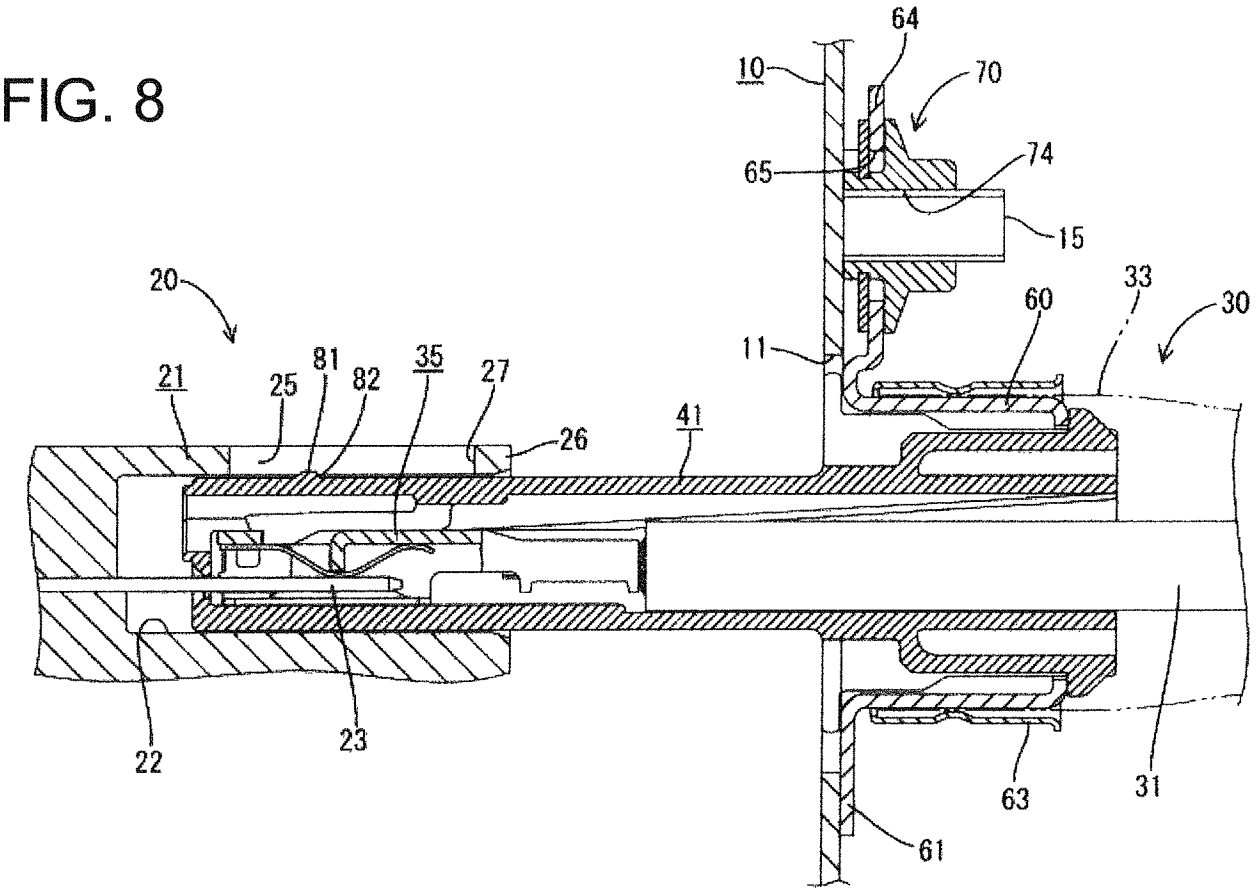
FIG. 8 is a longitudinal section along the switch portion of the interlock circuit.
Figure 9:
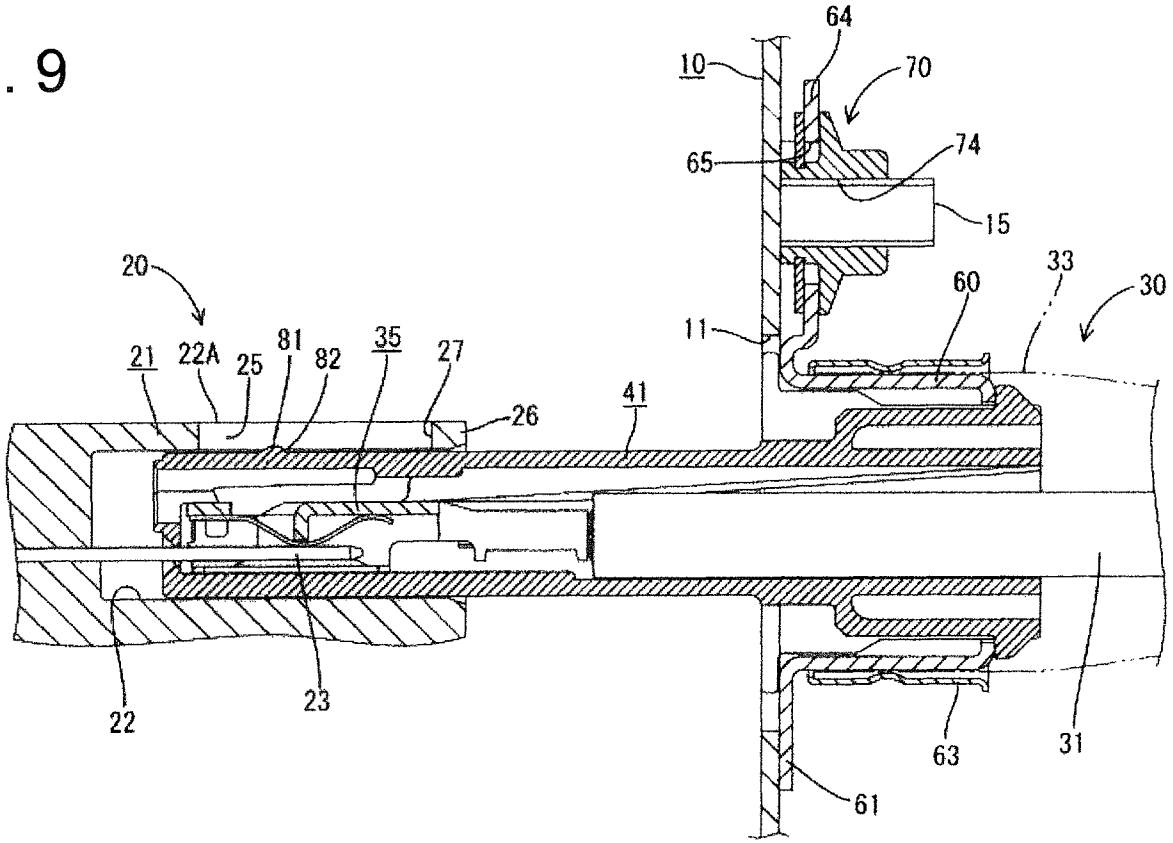
FIG. 9 is a longitudinal section along the connecting part of the connection terminals in a state where the two connectors are properly connected.

The nut 70 is tightened by a tool, such as a power wrench, so that the nut 70 moves threadedly forward along the stud bolt 15 and the power-supply side connector 40 integrally moves forward from the initially connected state to continue the connecting operation. The connecting operation is completed when the flange 61 of the shield shell 60 contacts the case 10 (properly connection position). At this time, the male and female terminals 23, 35 are connected more deeply, as shown in FIGS. 8 and 9, whereas the male tab 24 and the intermediate terminal 48 are connected to turn on the interlock circuit.

The power-supply side connector 40 moves back and is separated from the device side connector 20 by threadedly disengaging the nut 70 from the stud bolt 15. The power-supply side connector 40 returns to the initial connection position ICP of FIGS. 7 and 8 when the nut 70 is loosened sufficiently to detach from the stud bolt 15.

A partial locking mechanism 80 is provided between the power-supply side connector 40 and the device side connector 20 for preventing a movement of the power-supply side connector 40 in a separating direction SD with the power-supply side connector 40 held at the initial connection position ICP. The structure of the partial locking mechanism 80 is described below.

As shown in FIG. 4, a recessed groove 21A extends in forward and backward directions at a widthwise central position of an upper area of the connection recess 22 in the male housing 21 of the device side connector 20. An upper wall 22A is formed at a widthwise central position of the upper surface of the connection recess 22.

A locking groove 25 extends back on the upper wall 22A from a position slightly behind the front edge of the opening. A locking portion 26 is defined at a part of the upper wall 22A closer to the opening than the locking groove 25 and a locking surface 27 is defined on the rear surface of the locking portion 26.

On the other hand, an engaging portion 81 projects from the upper wall of the central cavity 42 and can fit into the locking groove 25. The engaging portion 81 is at a position to be located at the front end of the locking groove 25 when the power-supply side connector 40 is connected to the initial connection position ICP, as shown in FIG. 6.

The engaging portion 81 has a trapezoidal shape with front and rear obtusely inclined surfaces. Thus, engagement of a rear locking surface 82 of the engaging portion 81 with the locking surface 27 of the locking portion 26 prevents separation of the power-supply side connector 40 at the initial connection position ICP. However, the locking portion 26 will move along the obtusely inclined locking surface 82 and over the engaging portion 81 if the power-supply side connector 40 is grabbed and pulled with a specified force or larger, thereby releasing a locked state.

The movable contact 86B of the power-supply side connector 40 is mounted into the mounting hole 45 of the female housing 41 and the nut 70 is mounted on the mounting portion 62 on the shield shell 60 in the manner described above. Further, the respective female terminals 35 connected to the ends of the insulated wires 31 are accommodated into the cavities 42 of the female housing 41, and the end of the braided wire 33 is fit on the shield shell 60 and fixed by the crimp ring 63 to connect the power-supply side connector 40 to the end of the shielded cable 30.

The female housing 41 of the power-supply side connector 40 is fit through the connection opening 11 of the case 10 and into the connection recess 22 of the male housing 21 of the device side connector 20, as shown in FIGS. 5 and 6.

Figure 7:
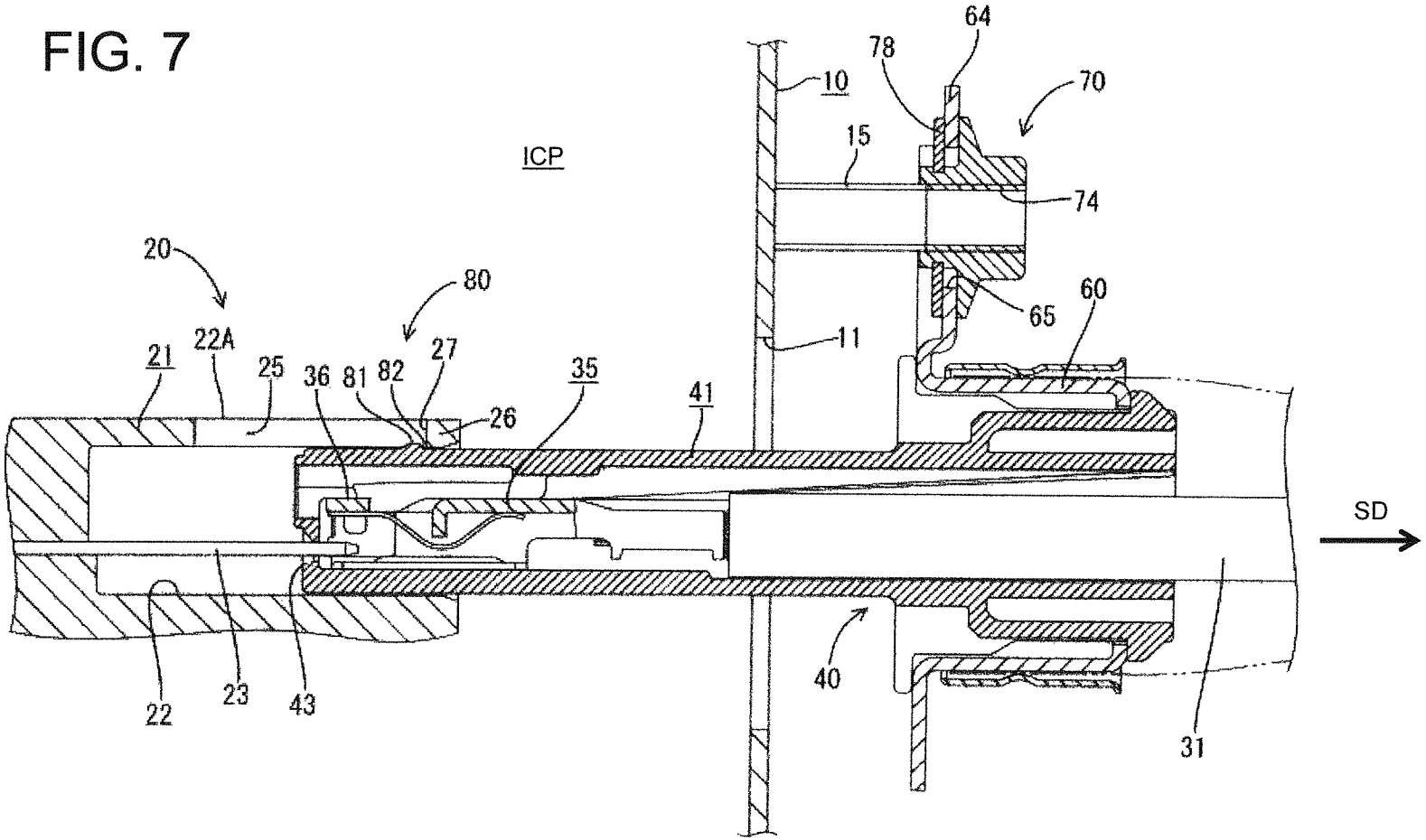
FIG. 7 is a longitudinal section cut along the connecting part of the connection terminals in a state where the two connectors are initially connected.

The upper wall of the cavity 42 from which the engaging portion 81 projects is deformed slightly as the female housing 41 is connected, but the connecting operation stops when the leading end of the internally threaded portion 74 of the nut 70 contacts the leading end of the stud bolt 15 extending from the case 10 (initial connection), as shown in FIGS. 7 and 8. The stud bolt 15 and the nut 70 may be misaligned due to a tolerance, but the leading end of the stud bolt 15 pushes the guiding surface 75 to move the nut 70 along the mounting plate 64 and into alignment.

The engaging portion 81 passes the engaging portion 26 and fits into the front end of the locking groove 25 when the initially connected state is reached. Thus, the upper wall of the cavity 42 is restored resiliently and the engaging portion 81 engages the locking surface 27 to hold the power-supply side connector 40 at the initial connection position ICP. The male terminals 23 of the device side connector 20 and the female terminals 35 of the power-supply side connector 40 start to connect to each other at this initial connection position ICP, as shown in FIG. 7, whereas the male terminal 24 and the intermediate terminal 84 of the switch portion 85 of the interlock circuit are not yet connected, as shown in FIG. 10.

A tightened by the tool, such as a power wrench, is used in this state, to advance the nut 70 threadedly forward along the stud bolt 15 so that the power-supply side connector 70 moves forward to continue the connecting operation. The connecting operation is completed at the proper connection position when the flange 61 of the shield shell 60 contacts the case 10, as shown in FIGS. 9 and 10. The male and female terminals 23, 35 are connected properly at this time so that the load side circuit and the power-supply side circuit are connected to form the power supply circuit. Additionally, the male tab 24 and the intermediate terminal 48 are connected to turn on the interlock circuit, set the load side circuit to the conductive state and consequently set the power supply circuit to the conductive state so that power is supplied from the power supply to the load.

The flange 61 of the shield shell 60 is fixed in contact with the case 10 so that electromagnetic noise generated from the insulated wires 31 is absorbed by the shield shell 60 via the braided wire 33 and is transferred to the case 10.

The power-supply side connector 40 may have to be detached from the device side connector 20 for maintenance or the like. Accordingly, the nut 70 on the power-supply side connector 40 is loosened with the tool and moves threadedly back along the stud bolt 15 from the state shown in FIGS. 9 and 10. The power-supply side connector 40 moves integrally with the nut 70 in the separating direction SD and separates from the device side connector 20. The power-supply side connector 40 is returned to the initial connection position ICP when the nut 70 is detached from the stud bolt 15, as shown in FIGS. 6 and 7

During this time, the male terminal 24 and the intermediate terminal 48 are separated to turn off the interlock circuit and to set the load side or power supply circuit to the cut-off state.

The locking surface 82 of the engaging portion 81 engages the locking surface 27 of the locking portion 26, thereby temporarily preventing any further separation of the power-supply side connector 40. Accordingly, the power-supply side connector 40 is not separated farther even if a force acts on the power-supply side connector 40 in a separating direction due to the weight of the shielded cable 30 or the like.

The power-supply side connector 40 is grabbed by the hand, tool or the like and pulled from the initial connection position ICP with a specified force or larger. As a result, the locking portion 26 moves along the obtusely inclined locking surface 82 and over the engaging portion 81. Thus, the locked state is released and the power-supply side connector 40 is pulled completely apart from the device side connector 20, as shown in FIG. 5.

As described above, the nut 70 is loosened with the tool to separate the power-supply side connector 40 gradually from the device side connector 20. Separation of the two connectors 20, 40 beyond the initial connection position ICP is prevented temporarily. During that time, the interlock circuit is turned off and the load side circuit, i.e. the power supply circuit, is set to the cut-off state. Thereafter, the power-supply side connector 40 may be pulled with a specified force or larger to release the locked state and pull the power-supply side connector 40 apart.

The power-supply side connector 40 is separated completely a certain time delay after the power supply circuit is set to the cut-off state. Any electric charges that remain on the male terminals 23 of the device side connector 20 are lost or decrease during the delay time so that an operator will not suffer from an electrical shock due to inadvertent contact with the male terminals 23.

Further, the stud bolt 15 extends from the case 10 of the device and the nut 70 is mounted on the power-supply side connector 40 for rotation about the axis line.

A bolt could be mounted on the power-supply side connector 40 for rotation about an axis line with a base end part of a shaft of the bolt fit and supported in the supporting hole 65 of the mounting portion 62. However, the mounting portion 62 must be relatively solid to withstand a load on the cantilevered shaft of the bolt. Further, the base end of the shaft of the bolt needs to be fit with a clearance into the supporting hole 65 to enable a position adjustment of the bolt to absorb the misalignment between the bolt and the nut when connecting the two connectors 20, 40. Thus, the leading end of the shaft may be lowered a large amount and must be lifted to a horizontal posture for proper alignment with the nut when the two connectors 20, 40 initially are connected. This adjustment of the bolt tends to be cumbersome.

Contrary to this, the nut 70 is mounted on the power-supply side connector 40 and only is rotatable about the axis. It is sufficient to fit the short cylindrical portion 73 at one end of the nut 70 with a clearance into the supporting hole 65 and to bring the nut 70 into contact with the mounting plate 64. Thus, the mounting portion 62 need not be as solid and the position of the nut 70 can be adjusted by moving the nut 70 along the mounting plate 64. Therefore, the initial connecting operation of the two connectors 20, 40 is easier.

The partial locking mechanism 80 for preventing separation of the power-supply side connector 40 beyond the initial connection position ICP and enabling separation of the power-supply side connector 40 in response to a specified separating force or larger is achieved by a simple structure. More particularly, the engaging portion 81 projects on the upper wall of the resiliently displaceable cavity 42 of the power-supply side connector 40 and has the obtusely inclined locking surface 82 that is engageable with the locking portion 26 on the ceiling surface of the connection recess 22 of the device side connector 20. This simple design can reduce production cost.

The present invention is not limited to the above described embodiment. For example, the following embodiments also are included in the scope of the invention.

In the above embodiment, the locking surface of the engaging portion is inclined obtusely to form the partial locking mechanism. However, the locking surface of the locking portion or both locking surfaces may be inclined obtusely.

The structure of the partial locking mechanism is not limited to the structure illustrated in the above embodiment and may be another structure that fulfills a function of preventing further separation of the power-supply side connector when the power-supply side connector is separated up to the initial connection position and enabling the power-supply side connector to be separated completely when a specified separating force or larger is applied to the power-supply side connector.

The structure of the part on which the nut is so mounted as to be only rotatable about the axis line is not limited to the structure illustrated in the above embodiment and can be arbitrarily changed.

The nut may be fixed on the device side and the bolt may be mounted on the power-supply side connector to be rotatable about the axis line.

The invention can be applied to a non-shield type connector device.

What is claimed is:

1. A connector device, comprising:

a device side connector mounted on a device and including a first connection terminal;

a power-supply side connector on an end of a power-supply side wire and including a second connection terminal, the power-supply side connector being connectable to the device side connector so that the second connection terminal connects to the first connection terminal to form a power supply circuit;

an interlock circuit for switching the power supply circuit between a conductive state and a cut-off state, the interlock circuit including at least one male tab provided in the recess of the device-side connector and at least one intermediate terminal provided in the power-supply side connector;

threadedly engageable connecting members mounted on the device and on the power-supply side connector for moving the power-supply side connector relative to the device side connector between an initial connection position where the first and second connection terminals are connected and the interlock circuit is in the cut-off state and a full connection position where the first and second connection terminals are connected and the interlock circuit is in the conductive state; and a partial locking mechanism provided between the power-supply side connector and the device side connector for preventing further separation when the power-supply side connector is separated to the initial connection position and the threadably engageable connecting members are separated from each other, and enabling the power-supply side connector to be separated completely when a specified force or larger is applied to the power-supply side connector.

2. The connector device of claim 1, wherein the partial locking mechanism is formed such that the power-supply side connector and the device side connector include a locking portion and an engaging portion that are brought into contact and engaged with each other, at least one of locking surfaces of the locking portion and the engaging portion being an obtusely inclined surface.

3. The connector device of claim 2, wherein threadedly engageable connecting members comprise a bolt mounted on the device, and a nut mounted on the power-supply side connector.

4. The connector device of claim 3, wherein the bolt and the nut are provided on the case and a mount plate provided on the shield shell to be mounted to the case.

5. The connector device of claim 1, wherein the device side connector is provided in or on a conductive case, the wire is a shielded cable, a shield shell connected to a shield layer of the shielded cable is mounted on the power-supply side connector.

* * * * *